United States Patent [19]

Wagner et al.

[11] Patent Number: 4,812,084

[45] Date of Patent: Mar. 14, 1989

[54] TUBBING RING FOR LINING A TUNNEL

[75] Inventors: Harald Wagner, Kirchenberg; Alfred Schulter, Linz, both of Austria

[73] Assignee: Ingenieure Mayreder, Kraus & Co. Baugeseilschaft M.b.H., Austria

[21] Appl. No.: 133,998

[22] Filed: Dec. 17, 1987

[30] Foreign Application Priority Data

Dec. 23, 1986 [AT] Austria ..... 3416/86

[51] Int. Cl.[4] ..... E21D 11/04

[52] U.S. Cl. ..... 405/153; 405/151

[58] Field of Search ..... 405/132, 150, 151, 152, 405/153

[56] References Cited

U.S. PATENT DOCUMENTS

| | | | |
|---|---|---|---|
| 673,852 | 5/1901 | MacHarg | 405/151 |
| 1,866,242 | 7/1932 | Warner et al. | 405/152 |
| 3,483,704 | 12/1969 | Tabor | 405/152 |
| 3,695,044 | 10/1972 | Hoshino et al. | 405/152 |
| 4,477,204 | 10/1984 | Rohde et al. | 405/153 |

*Primary Examiner*—David H. Corbin

*Attorney, Agent, or Firm*—Kurt Kelman

[57] ABSTRACT

A tubbing ring for lining a tunnel comprises end faces lying in respective planes, which preferably include an acute angle with each other. The tubbing ring comprises an even number of tubbing blocks, which have abutting longitudinal side faces that have such an inclination to a line which is parallel to the longitudinal axis of the ring that the tubbing blocks constitute ring segments which are substantially trapezoidal in a view on a diametral plane. In order to provide a tubbing ring which is of the kind described first hereinbefore and in which the assembling of the individual blocks is simplified and can be performed with a higher accuracy than before, each block is formed with recesses in its longitudinal side faces in a portion which extends radially at the center of the length of the side face, and in its end faces and said recesses are adapted to receive coupling elements for a positive guidance of the next tubbing block to be inserted into the same tubbing ring and of a corresponding tubbing block of an adjacent tubbing ring to be assembled, each of said longitudinal side faces and of said end faces is preferably smooth in a major part of its area.

7 Claims, 2 Drawing Sheets

FIG. 4
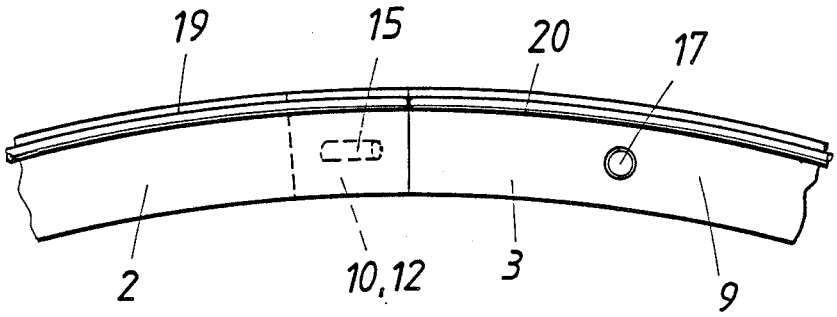
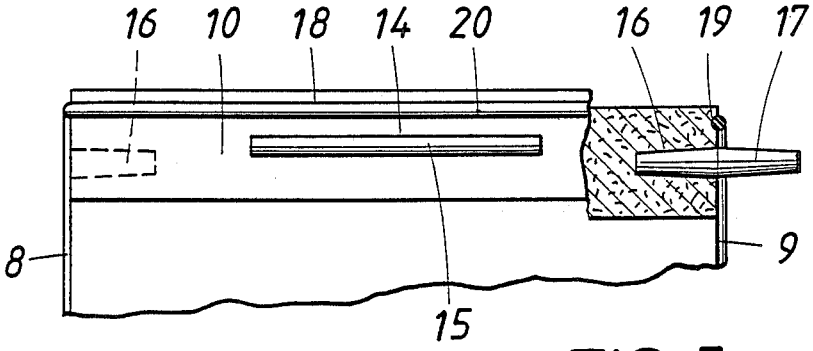
FIG. 5

TUBBING RING FOR LINING A TUNNEL

BACKGROUND OF THE INVENTION

1. Field of the Invention

This invention relates to a tubbing ring, which is to be used in a tunnel lining and has end faces lying in respective planes. The tubbing comprises an even number of tubbing blocks which have abutting longitudinal side faces so inclined to a line parallel to the longitudinal axis of the ring that the tubbing blocks constitute substantially trapezoidal ring segments, the tubbing blocks being joined by tongue-groove joints at their longitudinal side faces and adjacent rings being adapted to be coupled by coupling means.

2. Description of the Prior Art

Tubbing rings having that basic structure are known from U.S. Pat. No. 4,305,683, which also discloses various joints between adjacent tubbing rings.

Owing to the special shape of the tubbing blocks, the blocks of a tubbing ring can be assembled without requires substantial additional space in the direction in which the tunnel is driven. Owing to the trapezoidal basic shape of said blocks a keystone block which is to be arranged, e.g., at the top requires to be advanced in the direction in which the tunnel is driven beyond the existing portion of the ring only to such an extent that the keystone block can be inserted between the previously placed tubbing blocks which will laterally adjoin the keystone block. The extent to which the keystone block must protrude when it is to be inserted amounts only to a small fractional part of the longitudinal extent of the ring. If the end faces of the tubbing ring do not extend in parallel planes but extend in planes which include an acute angle with each other so that the entire ring in a top view has the configuration of a trapezoid having parallel sides which are constituted by the parallel end faces of the ring, it will be possible for the entire tunnel lining to follow curvatures of the longitudinal axis of the tunnel along a broken line which follows the route or gradient of the tunnel whereas straight sections of the lining can be formed from pairs of rings which have been inverted through 180° about their vertical axes.

In the previous practice the tubbing blocks are formed with recesses in that surface which constitutes the inside surface of the cylindrical ring and the tubbing blocks were coupled by means of tie bolts inserted into fixing holes in the lateral surfaces defining said recesses. For that purpose those blocks which are to be joined or blocks which are to be attached to an existing ring must provisionally be aligned before the tie bolts are inserted. That aligning is a complicated operation, which can be performed only by skilled workers and owing to the bulkiness of the parts often cannot be performed with the required precision. Whereas it has been proposed to form the concrete block on its longitudinal side faces with grooves and tongues, this will decrease the impact strength of the block and difficulties will arise particularly when a tubbing block is to be inserted between two existing blocks of the same ring, e.g., as the keystone block, because concrete surfaces will virtually not slide on each other and a displacement will result in a substantial abrasion. For this reason the tongue-and-groove joints cannot be designed for a close fit but an adequate clearance must be left. The formation of the abutting side faces with a profile has also the disadvantage that the blocks cannot be arranged as pairs of blocks which are inverted relative to each other. Any joint at which the tubbing blocks do not abut in the specified orientation will adversely affect the overall strength of the tubbing ring and will constitute a leak through which water can enter from the rock. It is often impossible to seal such leaks or they can be sealed only by a highly complicated operation.

SUMMARY OF THE INVENTION

It is an object of the invention to provide a tubbing ring which is of the kind described first hereinbefore and in which the assembling of the individual blocks is simplified and can be performed with a higher accuracy than before and the rings can be placed one adjacent to the other substantially without an offset and in such a manner that in the tunnel lining the longitudinal side faces and the end faces of adjacent blocks are in snug surface contact, the tubbing rings can be placed substantially without an offset and a reliably additional seal for the butt joints can be provided in case of need.

That object is basically accomplished a tubbing ring comprising an even number of adjoining blocks, each block having two substantially planar longitudinal side faces having two parallel longitudinal edges and whose planes are inclined to a line parallel to the ring axis and extend in a radical direction with respect to the ring whereby each block has a trapezoid configuration, and each longitudinal side face abutting a corresponding side face of an adjoining block in the ring, two opposite substantially planar end faces respectively extending in the planes of the tubbing ring end faces, at least one coupling recess in each planar end face, and a longitudinally extending groove in each planar longitudinal side face extending in a central portion thereof intermediate the opposite end faces and parallel to the longitudinal edges, the grooves in the abutting side faces being complementary and in registry with each other. A coupling element is received in each recess for coupling succeeding ones of the tubbing rings in the tunnel lining, and a plastic spline is inserted in the complementary grooves in the abutting side faces whereby the adjoining blocks are connected by tongue-and-groove joints. The splines are adapted for slidingly guiding the abutting side faces for sliding each block until the end faces thereof are flush with the end faces of the adjoining blocks and the coupling elements are adapted for sliding into a corresponding one of the coupling recesses in a respective planar end face of a block in a preceding one of the rings in the tunnel lining.

In accordance with the invention the tubbing blocks can be assembled in a modular system to form a ring in an exactly defined position relative to each other so that the assembling of a ring can be begun with a block disposed at any desired location and it is possible to form a tubbing ring by attaching blocks for said tubbing ring to an existing ring even when the floor of the tunnel has not yet been completely excavated for the next round. Similar advantages will be obtained when adjacent tubbing rings are joined. In the assembling of blocks of a given ring and in the making of a joint between adjacent rings there will be no offsets and substantial leaks will not be formed. The modular system employed can easily be assembled and inspected even by unskilled workers. The splines and coupling elements are inserted closely before the blocks are joined so that damage in transit can be avoided. The end faces and longitudinal side faces are substantially smooth so that they can easily be joined, offsets will be prevented and the blocks will contact each other almost without interstices. During an insertion of keystone blocks between previously placed blocks the plastic splines will constitute sliding guides, which have a low coefficient of friction and which will not be corroded because they consist of plastic. Owing to the taper of the longitudinal side faces there will be no sliding contact between concrete and concrete as the blocks are joined but the splines will positively interlock with the corresponding grooves without a play.

The splines which extend into the grooves of the longitudinal side faces may be circular in cross-section. Such round elements can easily be made and will effect an exact alignment of the adjacent blocks. In order to facilitate an insertion of blocks, such as the keystone block, between previously placed blocks, in order to reduce the risk of damage and to ensure a constant which is as snug as possible between adjacent longitudinal side faces of adjacent blocks of a ring, the grooves and the splines are provided only in an intermediate length portion of the longitudinal side faces whereas each of said side faces is smooth in a major part of its area. In that case the grooves will terminate short of the end faces. Nevertheless an adequate sliding guide will be provided, and the ends of the grooves and splines will define the required offset of the block to be inserted from the inside of the ring. It may be possible to provide grooves and splines which taper toward the end faces of the ring.

The end coupling elements may consist of biconical coupling plugs, which are adapted to be inserted into and are friction-fitted into holes formed in the end faces. Owing to their taper, the plug portions which protrude toward the adjoining blocks will effect a constraint by which the next block to be placed will be more exactly aligned. It will be understood that tie rods or other connecting means may be attached when the blocks have been assembled and the positive coupling means will ensure that openings for receiving such additional connecting means will be aligned.

If separate sealing means are desired, the tubbing blocks may be provided at their end faces and at their longitudinal side faces with seals, which extend parallel to the edges of the blocks and extend into receiving grooves. As the blocks and rings are assembled such seals will be protected from damage and displacement because the adjoining blocks are positively guided by the coupling means.

BRIEF DESCRIPTION OF THE DRAWING

FIG. 4 is an enlarged end view showing two adjoining tubbing blocks of a ring.

FIG. 5 is an enlarged elevation showing partly in section a tubbing block viewed from one side face.

DETAILED DESCRIPTION OF THE PREFERRED EMBODIMENT

Figure 1:
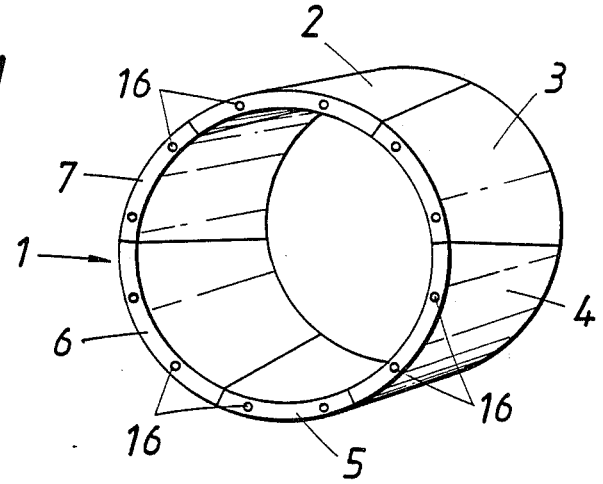
FIG. 1 is a perspective view showing a tubbing ring.

A simple illustrative embodiment of the invention will now be described with reference to the drawing. Alternative configurations of the tunnel and orientations of the blocks in the rings are apparent from U.S. Pat. No. 4,305,683.

Figure 2:
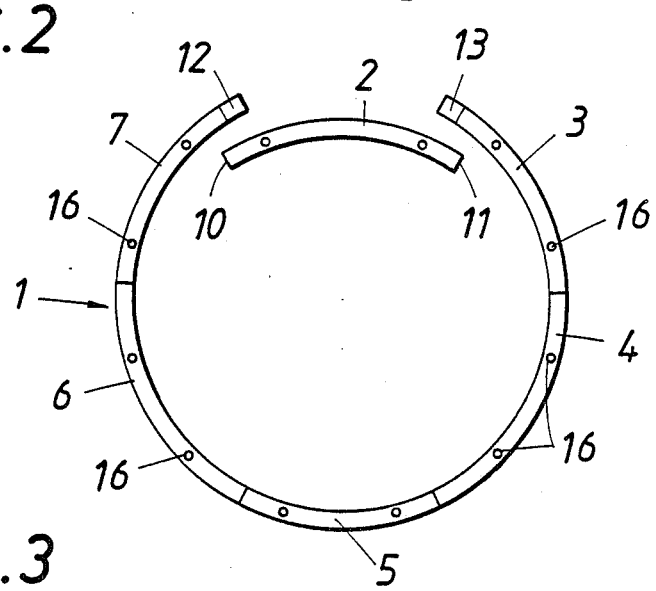
FIG. 2 is a front elevation showing a tubbing ring during the insertion of the keystone at the top.
Figure 3:
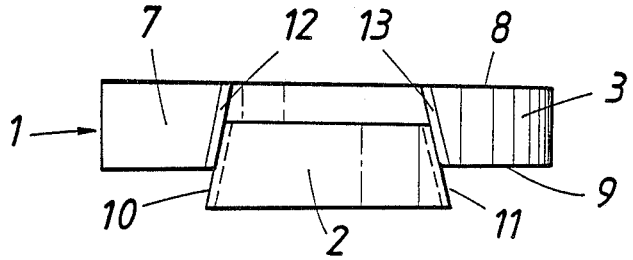
FIG. 3 is a top plan view of the keystone block of FIG. 2 being inserted between two adjoining blocks.

In the present embodiment a tubbing ring 1 shown in FIGS. 1 to 3 is composed of six tubbing blocks 2 to 7. At least pair of the blocks are identical. It is apparent from FIG. 3 that the end faces 8, 9 of the ring 1 lie in respective planes which include an acute angle with each other. In a view taken on a diametral plane, e.g., in a top plan view, the blocks have the configuration of a trapezoid so that adjoining blocks can be installed as pairs of relatively side-inverted blocks. In the present embodiment, the blocks of each of the pairs 2 and 5, 3 and 4 and 6 and 7 are identical.

The abutting side faces of the blocks 2, 3, 7 are designated 10, 11, 12 and 13 in FIG. 3. Corresponding faces are provided on all blocks 2 to 7. Faces 10 to 13 are so inclined relative to lines which are parallel to the longitudinal axis of the ring that each of the tubbing blocks 2 to 7 has basically the configuration of a ring segment which is trapezoidal in a view on a diametral plane of the ring. The longitudinal side faces 10 to 13 extend at the center of their length along radial lines from the axis of the ring and are generally planar in the illustrated embodiment.

As is apparent from FIGS. 2 and 3 the tubbing ring 1 is assembled from the blocks 3 to 7, which can be joined if an adequate space is available in the peripheral direction of the ring. To insert the keystone block, which in the illustrated embodiment is the top block 2, said block is partly inserted into the gap that has been left in the ring and is so arranged that the block is axially aligned with said gap and protrudes from the free end face 9 of the ring. The axial overhang of the block in that position has been exaggerated in FIG. 3 and it will be sufficient if said overhang is just large enough that the surfaces 10, 12 and 11, 13 will not contact each other until the block 2 has been fully inserted. In dependence on the inclination of said surfaces the required overhang will amount to 20 to 30 cm.

The side faces 10 to 13 are formed with grooves 14, which extend parallel to the longitudinal edges of the side faces and are identical but inverted relative to each other. The grooves are semicircular in cross-section and receive splines 15, which are circular in cross-section and consist of strong plastic material. As the block 2 is slidably inserted between blocks 3 and 7, splines 15 establish positive joints between adjoining blocks of the ring.

In the illustrated embodiment, each of the blocks 2 to 7 has in each of its end faces which will constitute portions of the end faces 8 and 9 of the ring two coupling recesses 16, each of which is adapted to positively and frictionally receive one half of a biconical coupling plug 17. Before a block of an additional ring is joined to an existing ring 1, said coupling plugs 17 are inserted into such additional block and owing to their insertion into the coupling recesses 16 of the preceding ring will constrain the attached block to move to a position of exact alignment with the corresponding block of the preceding ring. The peripheral distance between the two recesses 16 in each end face will be the same in both end faces of the same block and of all blocks so that each block can be joined to any other of the blocks.

As is shown in FIGS. 4 and 5, each of the end faces and side faces 10, 11, 12, 13 of each block is formed with sealing grooves 18, 19, which are parallel to the edges of said surfaces and which receive a peripherally extending sealing ring 20 so that the joints between adjacent end faces and side faces of adjacent blocks will be sealed, corresponding portions of the sealing rings 20 of adjacent blocks being in sealing contact with each other.

We claim:

1. A tubbing ring for lining a tunnel with a succession of said rings, the tubbing ring having two end faces lying in respective planes and a longitudinally extending axis intersecting the planes of the end faces, the tubbing ring comprising:

(a) an even number of adjoining blocks, (1) each block having two substantially planar longitudinal side faces whose planes are inclined with respect to a line parallel to the ring axis whereby each block has a trapezoidal configuration and the side faces having center lines extending in a radial direction with respect to the ring and two longitudinal edges extending parallel to the center line, and each longitudinal side face abutting a corresponding side face of an adjoining block in the ring, (2) two opposite substantially planar end faces respectively extending in the planes of the tubbing ring end faces, (3) at least one coupling recess in each planar end face, and (4) a longitudinally extending groove in each planar longitudinal side face extending in a central portion thereof intermediate the opposite end faces and parallel to the longitudinal edges, the grooves in the abutting side faces being complementary and in registry with each other, (b) a coupling element received in each recess for coupling succeeding ones of the tubbing rings in the tunnel lining, and (c) a plastic spline inserted in the complementary grooves in the abutting side faces whereby the adjoining blocks are connected by tongue-and-groove joints, the splines being adapted for slidingly guiding the abutting side faces for sliding each block until the end faces thereof are flush with the end faces of the adjoining blocks and the coupling elements being adapted for sliding into a corresponding one of the coupling recesses in a respective planar end face of a block in a preceding one of the rings in the tunnel lining.

2. The tubbing ring of claim 1, wherein the planes of the end faces include an acute dihedral angle.

3. The tubbing ring of claim 1, wherein the splines are circular in cross-section and the complementary grooves are correspondingly semi-circular.

4. The tubbing ring of claim 1, wherein the longitudinally extending grooves extend only in the central portion and terminate short of the end faces of the blocks.

5. The tubbing ring of claim 1, wherein each planar end face has two of said coupling recesses which are peripherally spaced apart equidistantly in all the tubbing ring blocks.

6. The tubbing ring of claim 5, wherein coupling recesses are blind holes and the coupling elements are biconical coupling plugs guidingly received in the coupling recesses in the end faces of the blocks of succeeding ones of the rings.

7. The tubbing ring of claim 1, wherein each end face and side face defines a sealing groove extending adjacent, and parallel, to an edge of the face, and further comprising sealing strips arranged on the sealing grooves.

* * * * *

UNITED STATES PATENT AND TRADEMARK OFFICE

CERTIFICATE OF CORRECTION

PATENT NO. : 4,812,084

DATED : MARCH 14, 1989

INVENTOR(S) : HARALD WAGNER ET AL

It is certified that error appears in the above-identified patent and that said Letters Patent is hereby corrected as shown below:

Cover page, item 73 , delete "Baugeseilschaft" and substitute therefor --Baugesellschaft--

Signed and Sealed this

Fourteenth Day of November, 1989

*Attest:*

JEFFREY M. SAMUELS

*Attesting Officer* *Acting Commissioner of Patents and Trademarks*